US012584259B2

(12) United States Patent
Sans Serra et al.

(10) Patent No.: US 12,584,259 B2
(45) Date of Patent: Mar. 24, 2026

(54) METHOD FOR CONTROLLING A SPIN CYCLE OF A WASHING MACHINE AND WASHING MACHINE

(71) Applicant: GIRBAU, S.A., Vic (ES)

(72) Inventors: Jordi Sans Serra, Gurb (ES); Eudald Bover Capdevila, Vic (ES); Francisco Alonso Mora, Manlleu (ES)

( * ) Notice: Subject to any disclaimer, the term of this patent is extended or adjusted under 35 U.S.C. 154(b) by 196 days.

(21) Appl. No.: 18/560,135

(22) PCT Filed: Mar. 28, 2022

(86) PCT No.: PCT/EP2022/058099

§ 371 (c)(1),
(2) Date: Nov. 10, 2023

(87) PCT Pub. No.: WO2022/238039

PCT Pub. Date: Nov. 17, 2022

(65) Prior Publication Data

US 2024/0240379 A1 Jul. 18, 2024

(30) Foreign Application Priority Data

May 13, 2021 (EP) ..... 21382444

(51) Int. Cl.

| | |
|---|---|
| ***D06F 33/48*** | (2020.01) |
| ***D06F 103/04*** | (2020.01) |
| ***D06F 103/24*** | (2020.01) |
| ***D06F 105/56*** | (2020.01) |

(52) U.S. Cl.
CPC ..... *D06F 33/48* (2020.02); *D06F 2103/04* (2020.02); *D06F 2103/24* (2020.02); *D06F 2105/56* (2020.02)

(58) Field of Classification Search
CPC ..... D06F 33/40; D06F 33/60; D06F 35/007
See application file for complete search history.

(56) References Cited

U.S. PATENT DOCUMENTS

| | | | | |
|---|---|---|---|---|
| 3,285,419 | A * | 11/1966 | Smith | D06F 33/48 74/572.4 |
| 2018/0148877 | A1* | 5/2018 | Chi | D06F 33/48 |
| 2020/0040509 | A1* | 2/2020 | Shinohara | D06F 33/48 |
| 2021/0115611 | A1* | 4/2021 | Choi | D06F 21/00 |

FOREIGN PATENT DOCUMENTS

| | | | | |
|---|---|---|---|---|
| EP | 3045580 | A1 * | 7/2016 | F16F 15/32 |

* cited by examiner

*Primary Examiner* — Spencer E. Bell
(74) *Attorney, Agent, or Firm* — Eugenio J. Torres-Oyola; Victor M. Rodriguez-Reyes; Rafael Rodriguez-Muriel

(57) ABSTRACT

Method for controlling a spin cycle of a washing machine and washing machine comprising a suspended group (10) including a rotative drum (11) contained in a dampened enclosure (12) supported on a suspension mechanism (20), a two axes accelerometer (30) supported on the suspended group (10), the method comprises the steps of capturing and analyzing vibration data (40) relative to the vibration of the suspended group (10) detecting a vibration data variation (43) over time indicative of a weight variation of the clothes due to the loss of water and determining a stabilization of the vibration data variation (43) over time indicative of the steadiness of the weight variation of the clothes due to end of the loss of water.

14 Claims, 4 Drawing Sheets

METHOD FOR CONTROLLING A SPIN CYCLE OF A WASHING MACHINE AND WASHING MACHINE

TECHNICAL FIELD

The present invention is directed towards a method for controlling a spin cycle of a washing machine using vibration data gathered from a two axes accelerometer attached to the suspended group of the washing machine. This vibration data is analyzed to determine when, during the centrifugal cycle, the clothes contained in the rotative drum of the suspended group ends the loss of water.

STATE OF THE ART

Several methods to adjust the centrifugal cycle in a washing machine are known. For example, document EP2056079 describe a method according to which the weight of the clothes contained in the rotative drum are measured before the addition of water and after the addition of water, to known how much water has to be drained therefrom during the centrifugal cycle.

Document EP2415919 describe an alternative method according to which the washing machine include several different programs optimized to different weights of cloths to be washed, selecting the weight of the cloths to be washed the optimal program is selected.

Document ES2641548T3 describe another method according to which the weight of the rotative drum content is measured during the centrifugal cycle, and when the reduction of weight is slowed down, indicative than most of the water has been already drained, the strop of the centrifugal cycle is triggered.

Document EP2977502A1 describe a method according to which the time required to extract certain amount of water from the clothes during the centrifugal cycle is measured and when said time is above certain threshold, the centrifugal cycle is ended.

Document EP3045580A1 describes a washing machine that includes intelligent movable counterweights which position around the drum is precisely controlled to compensate for the eccentricities produced by the clothes during the spin, detected by a two-axis accelerometer. Said intelligent movable counterweights reduces or eliminates the vibrations during the centrifugal cycle, but the data collected by the two axis-accelerometer are not analyzed to reduce the duration of the centrifugal cycle. This document does not adapt the duration of the centrifugal cycle to the drying state of the clothes contained in the drum.

Document US2018148877A1 describes a washing machine including an accelerometer measuring the vibration of the drum. When during the centrifugal cycle vibrations are above certain threshold, the drum is slowed down or stopped to redistribute the clothes, and the centrifugal cycle starts again. This document does not adapt the duration of the centrifugal cycle to the drying state of the clothes contained in the drum and only applies a centrifugal cycle according to a predefined standard program.

Document US2020040509A1 describes a washing machine including an accelerometer measuring the vibration of the drum and a control unit configured to determine the presence of waterproof clothes in the drum analyzing the vibrations detected by the accelerometer, and to set different predefined centrifugal cycles depending on the type of clothes detected, but this document does not adapt the duration of the centrifugal cycle to the drying state of the clothes contained in the drum.

None of those documents describe a method to precisely detect when the clothes contained in the drum are sufficiently dry based on the analysis of the vibration data obtained from an accelerometer, shortening the centrifugal time and reducing the energy consumption.

The present invention solves the above and other problems.

BRIEF DESCRIPTION OF THE INVENTION

The present invention is directed towards a method for controlling a spin cycle of a washing machine.

The washing machine on which this method is performed comprises a suspended group including a rotative drum contained in a dampened enclosure supported on a suspension mechanism.

The suspension mechanism supports the dampened group allowing its vibration and connecting the suspended group to an external chassis of the washing machine.

The washing machine further includes a two axes accelerometer supported on the suspended group to determine its acceleration in two orthogonal axes perpendicular to the rotation axis of the rotative drum and connected to an electronic control.

The two axes accelerometer is typically attached to the outside of the dampened enclosure and can be constituted by two independent single-axis accelerometers oriented in perpendicular directions or preferably by one single accelerometer which detects the accelerations in two orthogonal directions.

The proposed method comprises, in a manner already known, the following steps:

- perform a centrifugal cycle by accelerating the rotative drum to a centrifugal speed adjusted to retain the clothes against a perimeter of the rotative drum by a centrifugal force and by draining water and/or soapy water from the dampened enclosure;
- obtain, during the centrifugal cycle, vibration data relative to the vibration of the suspended group, produced by weight offset of the clothes, through the two axes accelerometer;

Before the centrifugal cycle, a cleaning cycle can also be performed by introducing water and/or soapy water into the rotative drum and by rotating the rotative drum to a tumbling speed adjusted to produce tumbling on clothes contained therein.

During the cleaning cycle the centrifugal force produced within the rotative drum, against its perimeter, is lower than the gravity, so that the clothes tumble in the rotative drum, increasing the cleaning effect of the water and/or of the soapy water.

During the centrifugal cycle, the centrifugal force produced within the rotative drum, against its perimeter, is bigger than the gravity, so that the clothes contained in the rotative drum are retained against the perimeter wall of the rotative drum and the water contained therein is expelled therefrom towards outside the rotative drum. Said expelled water is collected by the dampened enclosure surrounding the rotative drum and is later evacuated therefrom through the drainage outlet.

During the centrifugal cycle, the clothes contained in the rotative drum are commonly distributed on the perimeter of the rotative drum in an uneven manner, producing an offset in the weight distribution which, during the rotation of the rotative drum, produces vibrations of the rotative drum in the plane perpendicular to the rotation axis of the rotative drum. Because the rotative drum is connected to the dampened enclosure, said vibrations are transmitted to the dampened enclosure, producing the movement of the entire suspended group. The vibration is absorbed by the suspension mechanism, preventing its transfer to the external chassis of the washing machine.

Typically, the rotative axis is horizontal and the vibrations are produced in a vertical plane and are detected through said two axes accelerometer.

The proposed method further comprises, in a manner not known to the state of the art, the following steps:

analyzing by the electronic control unit the vibration data, provided by the two axes accelerometer, detecting a vibration data variation over time indicative of a weight reduction of the clothes due to the loss of water;

analyzing by the electronic control unit the vibration data variation determining a stabilization of the vibration data variation over time when the vibration data reduces at a pace below a predefined stabilization threshold, indicative of the steadiness of the weight reduction of the clothes due to end of the loss of water; and trigger an end of the centrifugal cycle in response to the stabilization of the vibration data variation.

According to that, the two axes accelerometer provides data relative to the vibration of the suspended group in the plane perpendicular to the rotation axis of the rotative drum.

Said vibration data are analyzed by the electronic control and variations of said vibrations are detected. For example, the electronic control can define a function indicative of the vibration data variation over time.

A vibration is a cyclic load, producing accelerations and decelerations, it will be understood that said variations are referred not to variations in the loads, which are constantly changing due to the cyclic nature of the vibration loads, but to variations in the maximum positive and/or negative detected values of said loads on each of the two orthogonal axes.

Said vibration variations can be produced by a change in the rotation speed of the rotative drum, by a variation in the weight distribution within the rotative drum or by a variation in the weight of the rotative drum content.

The rotation speed is controlled by the electronic control, so the electronic control knows when a variation in the rotation speed has been produced. During the centrifugal cycle, the centrifugal force retains the clothes against the perimeter wall of the rotative drum, preventing changes in its positions. Therefore, when vibration variations are detected during the centrifugal cycle without rotation speed variations, it is indicative of a weight loos due to the draining of the water content in the clothes caused by the centrifugal force.

When the analysis of the vibration data determines a steadiness of the vibration values, not related with changes in the rotation speed or when no changes in the rotation speed occurs, said steadiness indicates that proceeding with the centrifugal cycle will not substantially increase the water loss of the clothes, and then the electronic control can trigger the end of the centrifugal cycle saving energy and time.

The precise measurement of the vibrations suffered by the suspended group allow the precise control security margins, allowing for a tightening of said margins, increasing the efficiency of the system.

According to a preferred embodiment of the present invention, the analysis of the vibration data includes a filtration of the vibration data to isolate the maximal amplitude of each vibration, measured by the two axes accelerometer, disregarding the direction of said vibration in the plane defined by the two orthogonal axes perpendicular to the rotation axis of the rotative drum, obtaining maximal amplitude vibration parameters.

From said maximal amplitude vibration parameters a vibration reduction profile is calculated and said vibration reduction profile is used to detect the reduction pace of the vibrations contained in the vibration data, over time. Said detected reduction pace is used to determine when said reduction pace is below a predefined stabilization threshold.

The predefined stabilization threshold is a vibration reduction pace threshold predefined, typically stored and accessible to the electronic control unit, said predefined stabilization threshold being selected to be indicative of the steadiness of the weight reduction of the clothes due to end of the loss of water.

Typically, the vibration of the rotative drum having an uneven mass distribution produces an elliptic profile, the longest axis of said elliptic profile being the maximal amplitude of the vibration. The longest axis of the elliptic profile can have any direction in a plane perpendicular to the rotative drum. The variation of the magnitude of said maximal amplitude is relevant to determine the vibration data variation, but its direction, which can change along the centrifugal cycle, its not relevant and can be ignored.

If said vibration reduction profile is included in a graph having the amplitude in the vertical axis and the time in the longitudinal axis, a graph with a shape similar to a logarithmic shape with a horizontal asymptote is obtained, due to the reduction of the water loss velocity along the centrifugal cycle.

The filtration process can further disregard vibration data having a statistically deviation from the surrounding vibration data above a predefined deviation threshold, for example if a single vibration or a group of several consecutive vibrations during few seconds, for example less than 2 seconds, are equal or more than 10% or 15% above or below the pre and post vibrations.

Preferably, the maximal value of the vibration reduction profile, at the beginning of the centrifugal cycle once the centrifugal speed has been achieved, is set to be a reference value 100%, defining the rest of the vibration reduction profile as a % in regard to said reference value 100%, the stabilization threshold also being determined as a % in regard to said reference value 100%. For example, the stabilization threshold can be defined as a reduction of the vibration profile, produced during a period of at least 60 seconds, equal or lower than 5% or equal or lower than 2%, or a fraction of this period and percentage, for example a reduction equal or lower than 2.5% or 1% achieved during a 30 second period.

The stabilization threshold can be also adjusted depending if the priority is to maximize the drying effect or to reduce the centrifugal cycle duration or to reduce the energy consumption.

The maximal value of the vibration reduction profile can be very different in different centrifugal cycles, because it depends on the mass included in the rotative drum and also depends on the distribution of said mass within the rotative drum. A centrifugal cycle with a big mass with a big eccentricity will present a maximal vibration value much higher than a centrifugal cycle with a small mass with a small eccentricity, but both will present a vibration reduction profile with a very similar logarithmic shape but with different maximal magnitudes. This difference can be eliminated if the vertical axis is replaced by a % value, where 100% is the maximal amplitude at the beginning of the centrifugal cycle.

During the centrifugal cycle, the vibration data variation is calculated between several successive pairs of predefined time points determining the stabilization of the vibration data variation when one or several successive calculated variations of the vibration data are below the predefined stabilization threshold. Preferably said several pairs of time points are equidistant to each other.

According to that, the centrifugal cycle is divided in time segments, each time segment being comprised between two consecutive time points, and the vibration data variation is measured between said two consecutive time points, determining the variation within said time period. Preferably all the time periods have equal duration.

When the variation within on time period is equal or less than the predefined stabilization threshold, for example a reduction of the maximal vibration of only 5%, or only 3% or preferably only 2%, then the end of the centrifugal cycle is triggered.

Preferably, the variation of the vibration data is measured during a portion of the centrifugal cycle with a constant centrifugal velocity.

According to an embodiment of the present invention, at the beginning of the centrifugal cycle, if the analysis of the vibration data determines that the maximal amplitude of the vibrations is equal or above a predefined first vibration threshold then the rotation speed of the rotative drum is reduced to the tumbling speed or stopped, ending the centrifugal cycle, to change the clothes distribution within the rotative drum and a new centrifugal cycle is later started. This feature allows a change in the weight distribution of the clothes if an excessive vibration, above the first threshold, is detected during the centrifugal cycle, which can be harmful for the washing machine. This feature protects the washing machine from excessive vibrations. This test can be produced at a specific centrifugal velocity which can be different from, i.e. lower or higher than, the centrifugal velocity used later when the variation of the vibration data is analyzed to determine the stabilization of the vibration data.

If, at the beginning of the centrifugal cycle, the analysis of the vibration data determines that the maximal amplitude of the vibrations is comprised between the predefined first vibration threshold and a predefined second vibration threshold lower than the predefined first vibration threshold, the rotation speed of the rotative drum is maintained during a predefined period of time, for example a period comprised between ten seconds and hundred seconds, to drain some water.

Once those initial tests determine that the weight distribution is acceptable, then the centrifugal velocity can be adjusted to the desired centrifugal velocity to be used during the part of the centrifugal cycle during which the vibration data is analyzed to determine its stabilization, producing an acceleration or a deceleration of the centrifugal velocity. Said desired centrifugal velocity can be adjusted at different levels depending on the results of those initial tests, using higher or lower centrifugal velocities depending on the vibration level detected during those initial tests.

If after said predefined period of time the maximal amplitude keeps above the second threshold, then the rotation speed is reduced to the tumbling speed or stopped, ending the centrifugal cycle, to change the clothes distribution within the rotative drum and a new centrifugal cycle is later started.

During said predefined period of time the clothes will loss some water and some weight due to the centrifugal force, reducing the maximal amplitude of the vibrations. If said reduction is sufficient to reduce the maximal amplitude below the second vibration threshold then the centrifugal cycle can proceed, but if not, the centrifugal cycle will be finished reducing the rotation speed to the tumbling speed or stopping, and later restarted.

If, during the centrifugal cycle, the analysis of the vibration data determines that the maximal amplitude of the vibrations is equal or below the predefined second vibration threshold, the rotation speed of the rotative drum can be maintained. Alternatively, the rotation speed can be increased over time, for example in a stepped manner analyzing the vibration data after each increase, maintaining the maximal amplitude of the vibrations below the predefined second vibration threshold. An additional alternative is to increase over time the rotation speed maintaining the maximal amplitude of the vibration unchanged, increasing the rotation speed as the weight of the clothes is reduced due to the loss of water.

In successive centrifugal cycles attempts, the first and second vibration thresholds can be increased, maintaining the first vibration threshold below a maximal vibration threshold above which the vibration is harmful to the washing machine. By increasing said thresholds, the security margin is reduced, but the probability of a successful centrifugal cycle according to the proposed method is increased.

If the end of one centrifugal cycle due to an excessive vibration parameters and later restart of a new centrifugal cycle with a new weight distribution still produces vibrations with excessive maximal amplitude, the next centrifugal cycle is started with higher first and second thresholds, more easily achievable.

Thanks to this feature the initial centrifugal cycle attempts have a wider safety margins than later centrifugal cycle attempts, producing a lower machine wear in most washing cycles.

The centrifugal speed at which the centrifugal cycle is performed can be automatically set to be a speed at which the maximal amplitude of the vibrations reaches the predefined second vibration threshold. Then the centrifugal speed can be maintained constant during the rest of the centrifugal cycle or can be increased maintaining the maximal amplitude of the vibrations equal or below said predefined second vibration threshold.

It is also proposed to accelerate the rotative drum to a test speed during the initial portion of the centrifugal cycle. The test speed can be defined, for example, to produce a centrifugal force in the perimeter of the rotative drum comprised between 5 G and 12 G or preferably between 8 G and 11 G.

The method can further comprise predicting by the electronic control unit, from initial vibration data collected during the beginning of the centrifugal cycle and analyzed by the control unit, an expected evolution of the vibration data variation during the rest of the centrifugal cycle and a time forecast until the stabilization of the vibration data variation, the time forecast being obtained from the analysis of the expected evolution of the vibration data variation.

Said time forecast can be used to calculate or adapt the duration of the centrifugal cycle. Said duration of the centrifugal cycle can be communicated to the user through an interface such a screen.

The proposed method can be also defined as a computer implemented method.

According to a second aspect of the present invention, it is directed towards a washing machine comprising:

a suspended group including a rotative drum contained in a dampened enclosure supported on a suspension mechanism, the rotative drum being connected to the dampened enclosure through a driving shaft actuated through a variable-speed motor to produce its rotation around a rotation axis;

a two axes accelerometer supported on the suspended group to determine its acceleration in two orthogonal axes perpendicular to the rotation axis of the rotative drum and connected to an electronic control to communicate vibration data relative to the vibration of the suspended group, produced by weight offset of the clothes;

In a manner not known in the state of the art, the two axes accelerometer is a single accelerometer, preferably attached to the dampened enclosure, and the electronic control is also configured to implement the method described above, it is to say, to implement at least the following steps:

to analyze said vibration data to detect a vibration data variation over time indicative of a weight variation of the clothes due to the loss of water;

to determine a stabilization of the vibration data variation, indicative of the steadiness of the weight variation of the clothes due to end of the loss of water; and to trigger an end of the centrifugal cycle in response to the stabilization of the vibration data variation.

The suspension mechanism can be preferably configured to avoid resonance with vibration parameters produced by the rotative drum rotating at a speed lower to those required to produce a centrifugal force in its perimeter of 12 G.

It will also be understood that any range of values given may not be optimal in extreme values and may require adaptations of the invention to these extreme values are applicable, such adaptations being within reach of a skilled person.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and non-limitative manner, in which.

DETAILED DESCRIPTION OF AN EMBODIMENT

The foregoing and other advantages and features will be more fully understood from the following detailed description of an embodiment with reference to the accompanying drawings, to be taken in an illustrative and not limitative.

Figure 1:
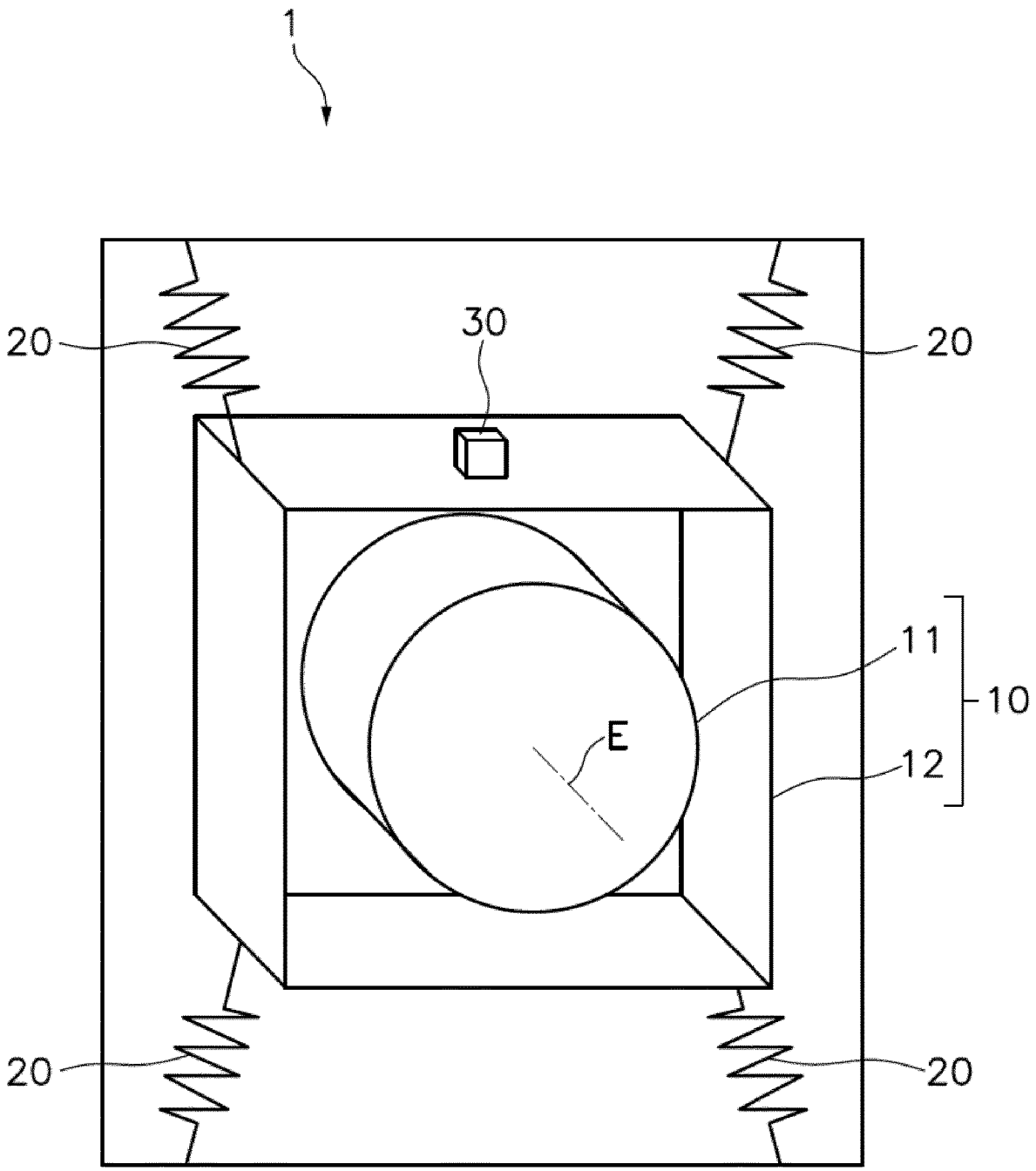
FIG. 1 is a schematic view of the washing machine, wherein the front side of the dampened enclosure has been removed in seek of clarity.

FIG. 1 shows the proposed washing machine, which includes an external chassis, containing a suspended group 10 formed by a dampened enclosure 12 containing a rotative drum 11.

The dampened enclosure 12 is connected to the external chassis through a suspension mechanism 20, for example formed by springs, elastic blocks, pistons, or a combination thereof, isolating the external chassis from the vibrations of the dampened enclosure 12.

The rotative drum 11 is connected to the dampened enclosure 12 through a driving shaft actuated through a variable-speed motor to produce its rotation around a rotation axis E.

The hollow interior of the rotative drum 11 is accessible through an opening of the dampened enclosure which can be hermetically sealed by a door, allowing for the introduction of extraction of clothes to be cleaned or dried.

The rotative drum is typically a cylindrical drum with two circular side walls and a cylindrical perimetral wall. The rotative drum is perforated allowing the entry and exit of water but retaining inside the clothes to be washed.

The dampened enclosure includes at least one water inlet and/or one soapy water inlet and one drainage outlet.

The variable-speed motor is typically attached outside the dampened enclosure.

The dampened enclosure 12 is connected to a drainpipe to evacuate the water contained therein.

According to this embodiment, a two axes accelerometer 30 is attached to the dampened enclosure 12 to measure vibrations of the suspended group 10 in two orthogonal axis X and Y, defining a plane perpendicular to the rotation axis E, said vibrations being produced by the rotation of an eccentric weight distribution of the wet cloths within the rotative drum 11.

Figure 2:
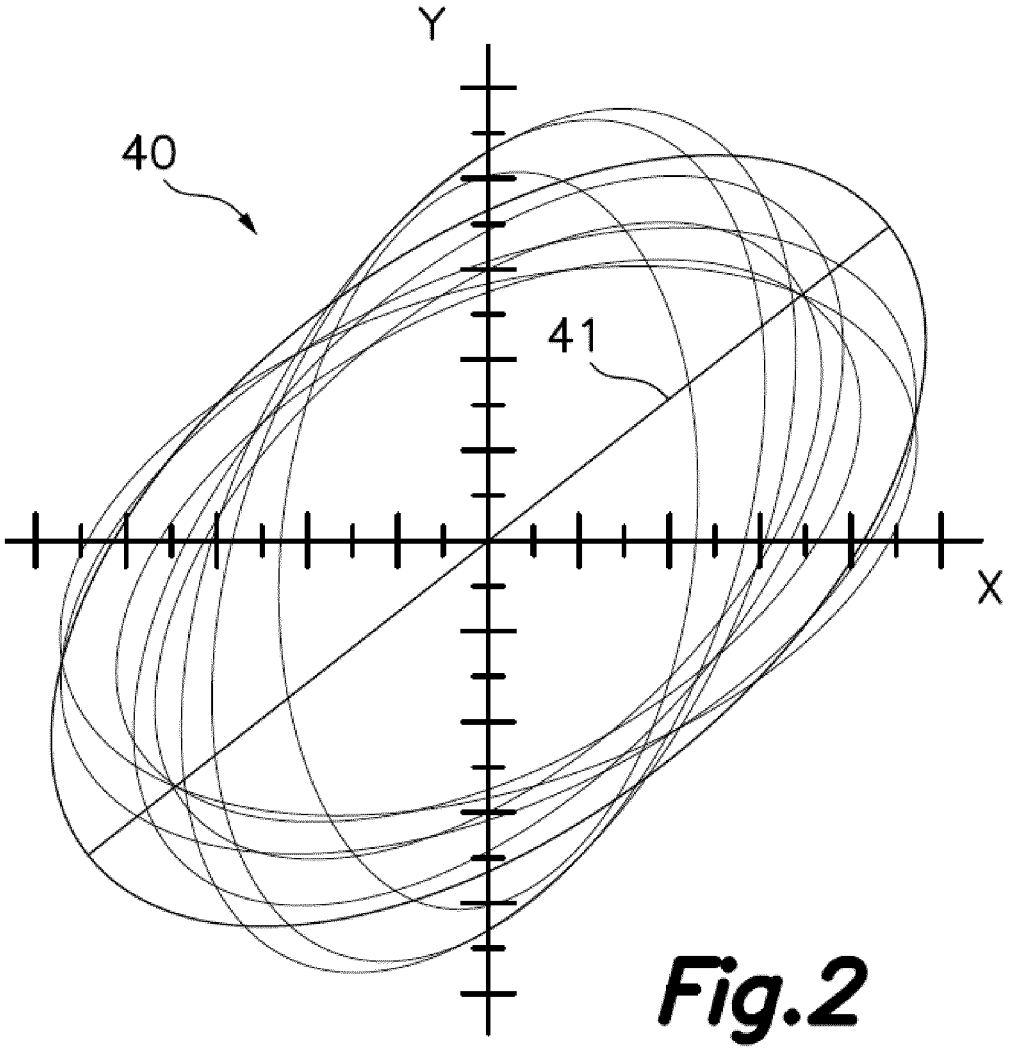
FIG. 2 is a schematic view of the vibration data obtained from the two axes accelerometer during a typical centrifugal cycle, and wherein the maximal amplitude of one single vibration has been drawn as a straight diagonal line.

FIG. 2 shows a graph of the vibration data 40 obtained by the two axes accelerometer 30. Each rotation of the rotative drum 11 produces one elliptic-like vibrational movement of the suspended group 10. Each elliptic-like vibration defines one maximal amplitude 41 of the vibration coincident with the longest diagonal of said elliptic-like vibrational movement.

Figure 3:
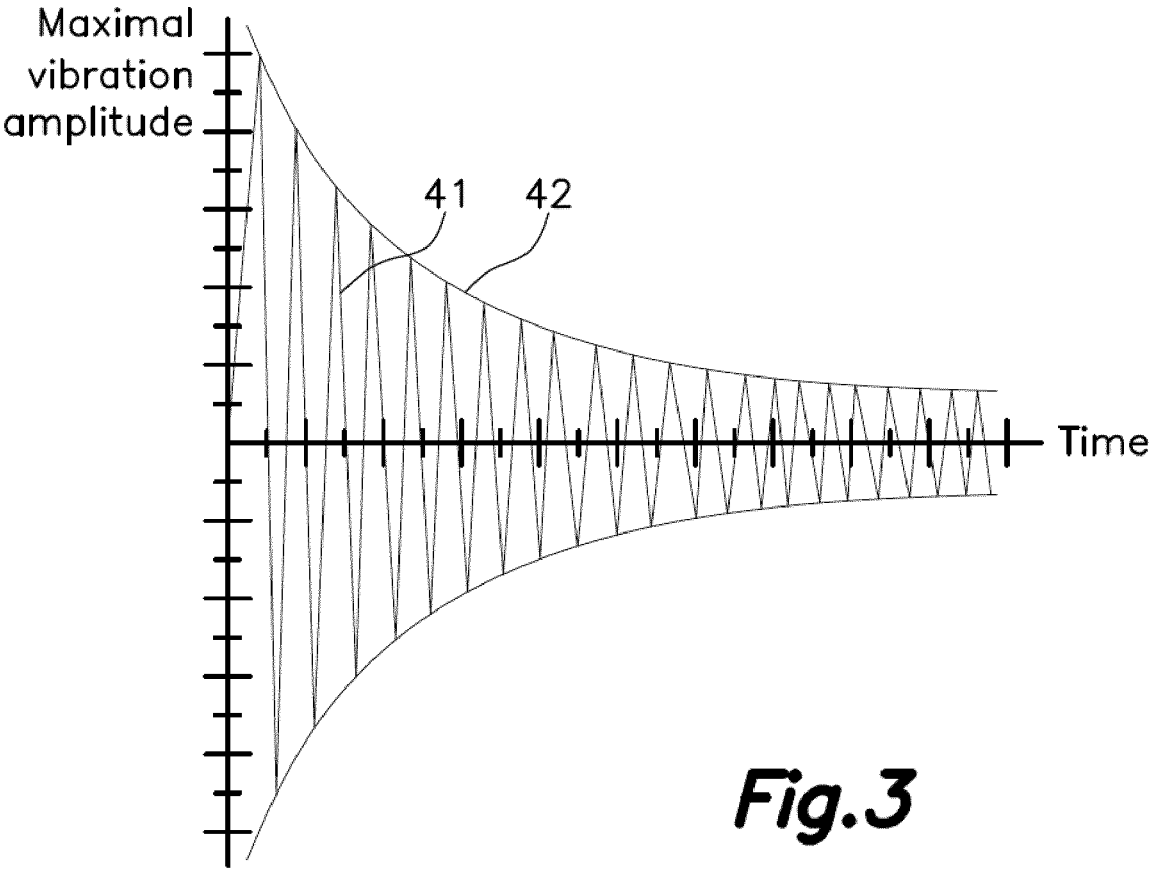
FIG. 3 is a schematic view of the filtered vibration data, showing only the evolution of the maximal amplitude of the vibrations during the centrifugal cycle, the maximal amplitude of the vibrations determining a line correspondent to the vibration data variation, which typically corresponds to a logarithmic-like decreasing line.

FIG. 3 shows the result of filtration of the vibrational data 40 to isolate the maximal amplitude 41 of each vibration during the centrifugal cycle.

During the centrifugal cycle, the maximal amplitude 41 of the vibrations is reduced over time due to the loss of weight of the clothes contained in the rotative drum 11. Typically, the reduction of the maximal amplitudes 41 of the vibrations during the centrifugal cycle produces a logarithmic-like graph, corresponding to the vibration data variation 42, which tends to a horizontal asymptote. When the vibration data variation 42 approaches to the asymptote, it is indicative of the end of the loss of water of the clothes and the centrifugal cycle can be finished.

Figure 4:
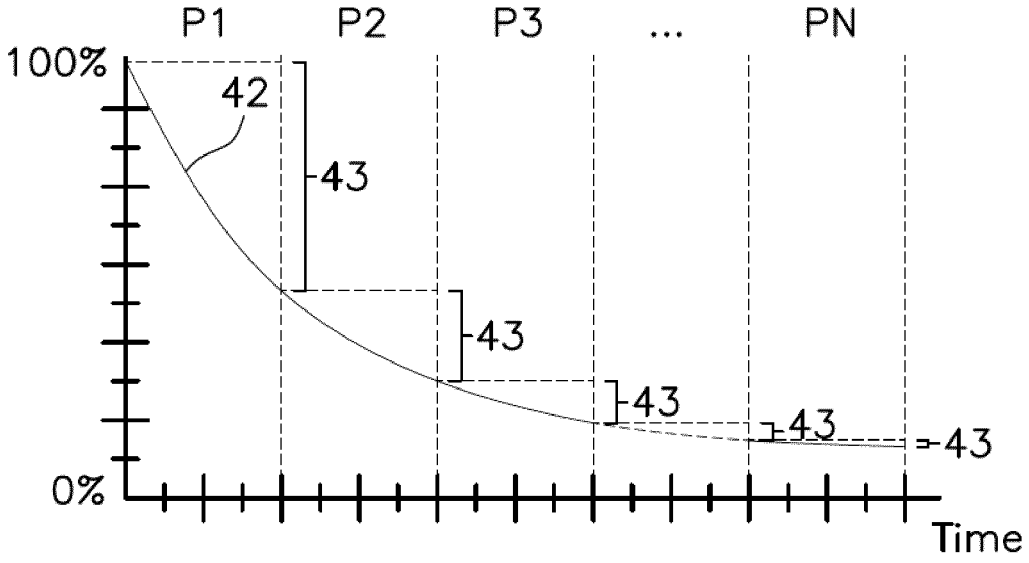
FIG. 4 is a schematic view of the line defining the vibration data variation, wherein the several time periods have been indicated and the vibration data variation has been measured within each of said time periods.

FIG. 4 shows how, if the centrifugal cycle is divided in several time periods P1, P2, P3, . . . PN of the same extension, for example periods of between 10 seconds and 100 seconds, the reduction of the maximal vibration on each period is smaller than the reduction on the preceding periods. Once the reduction within one period is below a stabilization threshold, the stabilization of the loss of water is determined and the centrifugal cycle is ended.

Preferably, after the determination of the stabilization of the vibration data variation 43, it is also verified if the centrifugal cycle has last for at least a minimal centrifugal period T2 before ending the centrifugal cycle, extending the centrifugal cycle until said minimal centrifugal period T2 has expired before finishing the centrifugal cycle.

Figure 5:
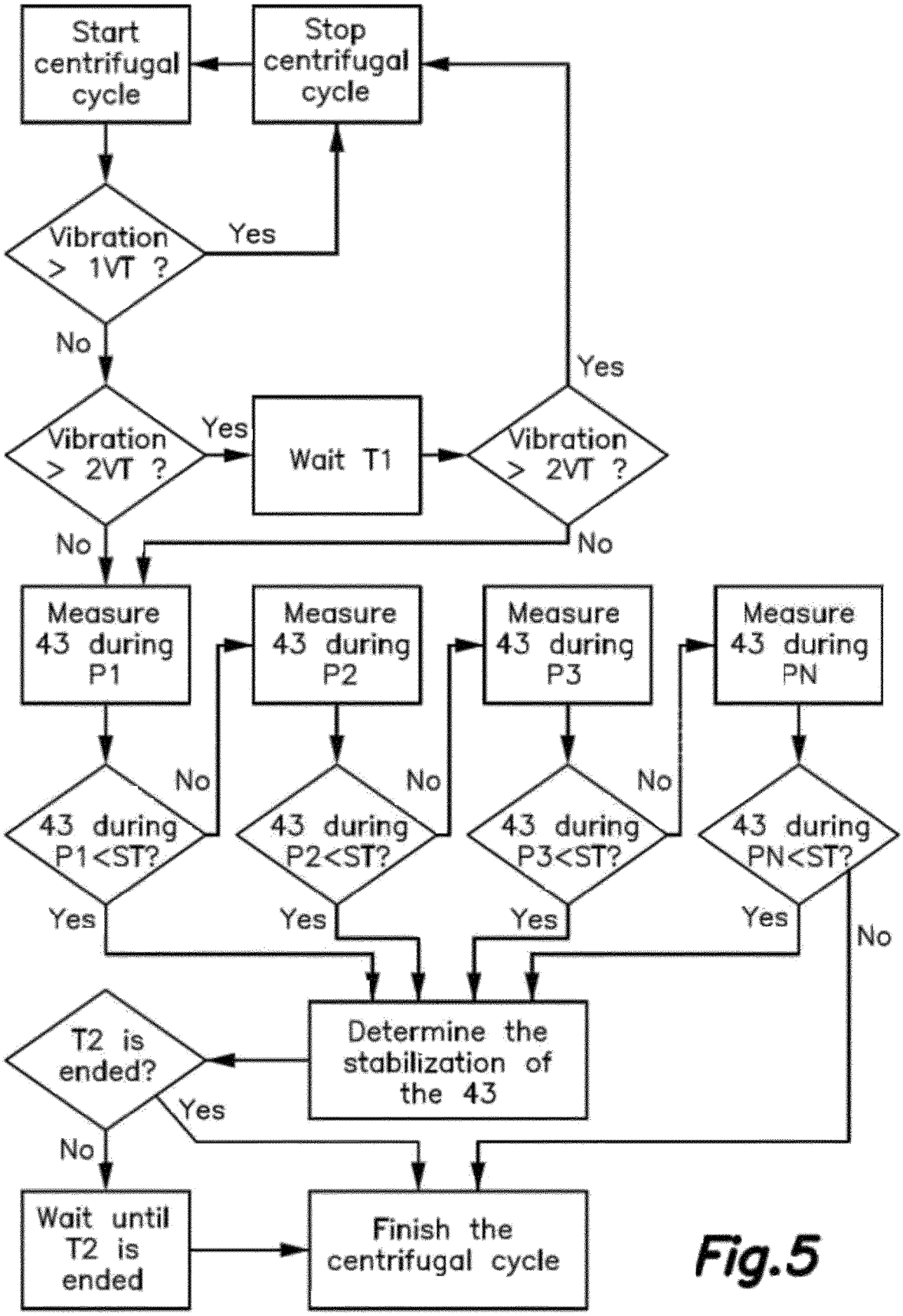
FIG. 5 is a flowchart showing one proposed embodiment of the proposed method.

FIG. 5 shows a flowchart showing how the centrifugal cycle is controlled.

At the beginning of the centrifugal cycle, once the centrifugal speed has been reached, if the vibration of the suspended group 10, preferably the maximal amplitude 41 of said vibrations, is above a first vibration threshold 1VT, the centrifugal cycle is aborted and restarted, producing a redistribution of the weight within the rotative drum 11.

If the vibration is below said first vibration threshold 1VT, then it is verified if the vibration of the suspended group 10 is above a second vibration threshold 2VT lower than the first vibration threshold 1VT.

When the vibration is below the second vibration threshold 2VT, the centrifugal cycle proceeds. When the vibration is above the second vibration threshold 2VT, then the centrifugal cycle is maintained for a period of time T1, for example a period comprised between 10 and 100 seconds, allowing for a certain loss of weight and vibration reduction. If after said period of time T1 the vibration is below the second vibration threshold 2VT, the centrifugal cycle proceeds. If after said period of time T1 the vibration is still above the second vibration threshold 2VT, then the centrifugal cycle is aborted and restarted, producing a redistribution of the weight within the rotative drum 11.

Once these initial checks have been done successfully, the velocity of the reduction of the vibration is analyzed, for example verifying the vibration data variation 43 on said successive periods of time P1, P2, P3, . . . PN shown on FIG. 4.

Once the vibration reduction is below a certain stabilization threshold, being then the loss of water irrelevant or almost irrelevant, the centrifugal cycle can be finished.

If after a certain time, for example once the period PN is reached, the stabilization threshold has not yet been reached, the centrifugal cycle can be finished automatically to avoid an excessive duration thereof.

The invention claimed is:

1. Method for controlling a spin cycle of a washing machine, the washing machine comprising:

a suspended group including a rotative drum contained in a dampened enclosure supported on a suspension mechanism, the rotative drum being connected to the dampened enclosure through a driving shaft actuated through a variable-speed motor to produce a rotation of the rotative drum around a rotation axis;

a two axes accelerometer connected to an electronic control and supported on the suspended group to determine an acceleration of the rotative drum in two orthogonal axes perpendicular to the rotation axis;

wherein the method comprises:

performing a centrifugal cycle by accelerating the rotative drum to a centrifugal speed adjusted to retain clothes contained in the rotative drum against an inner perimeter of the rotative drum by a centrifugal force and by draining water from the dampened enclosure;

capturing, during the centrifugal cycle by said two-axis accelerometer, vibration data relative to the vibration of the suspended group, produced by weight offset of the clothes;

analyzing, during the centrifugal cycle and by the electronic control unit, the vibration data, provided by the two axes accelerometer, detecting a vibration data variation over time, indicative of a weight reduction of the clothes due to the loss of water;

analyzing, during the centrifugal cycle and by the electronic control unit, the vibration data variation to determine a stabilization of the vibration data variation over time when the vibration data decreases at a pace below a predefined stabilization threshold, indicative of the steadiness of the weight reduction of the clothes due to end of the loss of water; and triggering an end of the centrifugal cycle in response to the stabilization of the vibration data variation.

2. The method according to claim 1 wherein the analysis of the vibration data includes a filtration of the vibration data to isolate the maximal amplitude of each vibration, measured by the two axes accelerometer, disregarding the direction of said vibration in a plane perpendicular to the rotation axis of the rotative drum, obtaining maximal amplitude vibration parameters from which a vibration reduction profile is calculated, using said vibration reduction profile to determine the stabilization of the vibration data variation over time.

3. The method according to claim 2 wherein the filtration process further includes disregarding vibration data having a statistically deviation from the surrounding vibration data above a predefined deviation threshold.

4. The method according to claim 2 wherein the maximal value of the vibration reduction profile, at the beginning of the centrifugal cycle once the centrifugal speed has been achieved, is set to be a reference value 100%, defining the rest of the vibration reduction profile as a % in regard to said reference value 100%, the stabilization threshold also being determined as a % in regard to said reference value 100%.

5. The method according to claim 2 wherein, during the centrifugal cycle, the vibration data variation, used to detect the stabilization of the vibration data variation, is calculated between several successive pairs of predefined time points, or between several successive pairs of equidistant predefined time points, determining the stabilization of the vibration data variation when one or several successive calculated vibration data variations are below the predefined stabilization threshold.

6. The method according to claim 1 wherein if, at the beginning of the centrifugal cycle, the analysis of the vibration data determines that the maximal amplitude of the vibrations is equal or above a predefined first vibration threshold the centrifugal cycle is aborted, stopping the rotative drum or reducing the rotation speed of the rotative drum to a tumbling speed, to change the clothes distribution within the rotative drum and a new centrifugal cycle is later restarted.

7. The method according to claim 6 wherein if, at the beginning of the centrifugal cycle, the analysis of the vibration data determines that the maximal amplitude of the vibrations is comprised between the predefined first vibration threshold and a predefined second vibration threshold lower than the predefined first vibration threshold, the rotation speed of the rotative drum is maintained during a predefined period of time and, if after said predefined period of time the maximal amplitude of the vibrations remains above the second vibration threshold, then the centrifugal cycle is aborted, stopping the rotative drum or reducing the rotation speed of the rotative drum to the tumbling speed, to change the clothes distribution within the rotative drum and a new centrifugal cycle is later restarted.

8. The method according to claim 7 wherein in successive centrifugal cycles attempts the first and second vibration thresholds are increased, maintaining the first vibration threshold below a maximal vibration threshold.

9. The method according to claim 7 wherein the centrifugal speed is automatically set to be a speed at which maximal amplitude of the vibrations reach the predefined second vibration threshold.

10. The method according to claim 9 wherein during the centrifugal cycle the centrifugal speed is increased maintaining the maximal amplitude of the vibrations equal or below said predefined second vibration threshold.

11. The method according to claim 1 wherein, before starting the centrifugal cycle, the rotative drum is accelerated to a test speed defined to produce a centrifugal force in the perimeter of the rotative drum comprised between 5 G and 12 G or preferably between 8 G and 11 G.

12. The method according to claim 1, wherein the method further comprises predicting by the electronic control unit, from initial vibration data 40 collected during the beginning of the centrifugal cycle analyzed by the control unit, an expected evolution of the vibration data variation during the rest of the centrifugal cycle and a time forecast until the stabilization of the vibration data variation, the time forecast being obtained from the analysis of the expected evolution of the vibration data variation.

13. A washing machine comprising:

a suspended group including a rotative drum contained in a dampened enclosure supported on a suspension mechanism, the rotative drum being connected to the dampened enclosure through a driving shaft actuated through a variable-speed motor to produce a rotation of the rotative drum around a rotation axis;

a two axes accelerometer supported on the suspended group to determine an acceleration thereof in two orthogonal axes perpendicular to the rotation axis of the rotative drum and connected to an electronic control to communicate vibration data relative to the vibration of the suspended group, produced by weight offset of the clothes;

the electronic control is further configured to implement the method according to any of the preceding claims, and the two axes accelerometer is a single accelerometer.

14. The washing machine according to claim 13 wherein the suspension mechanism has been configured to avoid resonance with vibration parameters produced by the rotative drum rotating at a speed lower to those required to produce a centrifugal force in its perimeter of 12 G.

* * * * *